US010112745B2

(12) United States Patent
Foshansky et al.

(10) Patent No.: US 10,112,745 B2
(45) Date of Patent: Oct. 30, 2018

(54) SELECTIVELY ACCESSIBLE CONTAINER APPARATUS, HINGE ASSEMBLY WITH A SHAPE MEMORY ALLOY FILAMENT, AND METHODS

(71) Applicant: Autosplice, Inc., San Diego, CA (US)

(72) Inventors: Leonid Foshansky, San Diego, CA (US); Kenneth Krone, San Diego, CA (US)

(73) Assignee: Autosplice, Inc., San Diego, CA (US)

( * ) Notice: Subject to any disclaimer, the term of this patent is extended or adjusted under 35 U.S.C. 154(b) by 26 days.

(21) Appl. No.: 15/331,486

(22) Filed: Oct. 21, 2016

(65) Prior Publication Data

US 2017/0121068 A1 May 4, 2017

Related U.S. Application Data

(60) Provisional application No. 62/245,154, filed on Oct. 22, 2015.

(51) Int. Cl.

| | |
|---|---|
| ***B65D 43/26*** | (2006.01) |
| ***B65D 43/16*** | (2006.01) |
| ***B65D 55/14*** | (2006.01) |
| ***E05F 15/60*** | (2015.01) |
| ***E05D 11/00*** | (2006.01) |

(52) U.S. Cl.

CPC ..... *B65D 43/26* (2013.01); *B65D 43/163* (2013.01); *B65D 55/14* (2013.01); *E05D 11/0054* (2013.01); *E05F 15/60* (2015.01); *B65D 55/145* (2013.01); *E05D 2011/0072* (2013.01); *E05Y 2900/602* (2013.01)

(58) Field of Classification Search

CPC ..... B65D 43/26; B65D 55/14; B65D 43/163; B65D 55/145; E05F 15/60; E05D 11/0054; E05D 2011/0072; E05Y 2900/602

See application file for complete search history.

(56) References Cited

U.S. PATENT DOCUMENTS

| | | | |
|---|---|---|---|
| 6,008,992 | A | 12/1999 | Kawakami |
| 6,485,081 | B1 | 11/2002 | Bingle et al. |
| 6,815,873 | B2 | 11/2004 | Johnson et al. |
| 6,840,257 | B2 | 1/2005 | Dario et al. |
| 6,843,465 | B1 | 1/2005 | Scott |

(Continued)

FOREIGN PATENT DOCUMENTS

| | | | |
|---|---|---|---|
| JP | H02306082 | A | 12/1990 |
| JP | H03169996 | A | 7/1991 |

*Primary Examiner* — Brian Miller

(74) *Attorney, Agent, or Firm* — Gazdzinski & Associates, PC

(57) ABSTRACT

Apparatus and methods for selectively providing or preventing access to areas, enclosed spaces or volumes, or for controlling the position of a pivot or hinge assembly. In one exemplary embodiment, the apparatus includes a selectively actuated or actuate-able hinge which is controlled at least in part by a shaped memory alloy (SMA) filament or filaments. Application of electrical current to the filament causes changes in the physical properties thereof, thereby allowing "ratcheted" rotation of a portion of the hinge relative to other portions. In one variant, the hinge can be remotely operated, such as via wireless or wireline communication with a remote entity such as a computer or smartphone.

20 Claims, 14 Drawing Sheets

(56) References Cited

U.S. PATENT DOCUMENTS 6,973,701 B2 12/2005 Momoda et al.
7,013,536 B2 3/2006 Golden et al.
7,032,282 B2 4/2006 Powell et al.
7,055,793 B2 6/2006 Biehl et al.
7,347,221 B2 3/2008 Berger et al.
7,650,914 B2 1/2010 Bogursky et al.
7,926,520 B2 4/2011 Bogursky et al.
8,113,243 B2 2/2012 Bogursky et al.
8,540,206 B2 9/2013 Foshansky et al.
8,851,443 B2 10/2014 Foshansky
8,876,062 B1 * 11/2014 Baghdasarian ..... B64G 1/222 16/231
8,939,180 B2 1/2015 Bogursky et al.
8,946,934 B2 2/2015 Butts et al.
9,027,903 B2 5/2015 Arekar et al.
9,932,757 B2 * 4/2018 Hager ..... E05B 47/0009
2002/0195177 A1 * 12/2002 Hinkley ..... C22F 1/006 148/559
2005/0005980 A1 1/2005 Eberhardt et al.
2005/0198777 A1 * 9/2005 Mabe ..... E05D 5/10 16/308
2006/0186700 A1 8/2006 Browne et al.
2006/0186706 A1 8/2006 Browne et al.
2006/0232051 A1 10/2006 Morris et al.
2007/0063540 A1 3/2007 Browne et al.
2007/0063541 A1 3/2007 Browne et al.
2007/0080013 A1 * 4/2007 Melz ..... B60N 2/14 180/274
2007/0118831 A1 5/2007 Kondo
2007/0261307 A1 11/2007 Alexander et al.
2008/0007081 A1 1/2008 Shibata et al.
2008/0100079 A1 * 5/2008 Herrera ..... B60R 7/06 296/37.1
2008/0100092 A1 5/2008 Gao et al.
2008/0120911 A1 * 5/2008 Browne ..... E05B 47/0009 49/352
2009/0322531 A1 * 12/2009 Estevez ..... E05B 47/0009 340/572.1
2012/0151913 A1 6/2012 Foshansky
2013/0091772 A1 * 4/2013 Berger ..... F25C 5/22 49/324
2013/0111896 A1 5/2013 Foshansky et al.
2015/0267690 A1 9/2015 Foshansky et al.
2016/0208539 A1 * 7/2016 Hofmann ..... F03G 7/065
2017/0089641 A1 * 3/2017 Humfeld ..... F27D 19/00

* cited by examiner

SELECTIVELY ACCESSIBLE CONTAINER APPARATUS, HINGE ASSEMBLY WITH A SHAPE MEMORY ALLOY FILAMENT, AND METHODS

PRIORITY AND RELATED APPLICATIONS

This application claims the benefit of priority to co-owned U.S. Provisional Patent Application Ser. No. 62/245,154 filed Oct. 22, 2015 of the same title, the contents of the foregoing being incorporated herein by reference in its entirety.

This application is related to co-owned U.S. patent application Ser. No. 13/372,199 filed on Feb. 13, 2012 and entitled "Apparatus and Methods for Filament Crimping and Manufacturing", now U.S. Pat. No. 8,939,180; which is a divisional of and claims priority to co-owned U.S. patent application Ser. No. 12/892,208 filed Jul. 1, 2010 of the same title, now U.S. Pat. No. 8,113,243; which is a divisional of and claims priority to co-owned U.S. patent application Ser. No. 11/473,567 filed Jun. 22, 2006 of the same title, now U.S. Pat. No. 7,650,914, each of the foregoing incorporated herein by reference in its entirety.

This application is also related to co-owned U.S. patent application Ser. No. 12/539,521 filed on Aug. 11, 2009 and entitled "Multi-Stable Actuation Apparatus and Methods for Making and Using the Same", now U.S. Pat. No. 8,540,206; which claims the benefit of priority to co-owned U.S. Provisional Patent Application Ser. No. 61/189,148 filed Aug. 14, 2008 of the same title; as well as claims the benefit of priority to co-owned U.S. Provisional Patent Application Ser. No. 61/206,883 filed Feb. 4, 2009 entitled "Memory Alloy-Actuated Apparatus and Methods for Making and Using the Same", each of the foregoing incorporated herein by reference in its entirety.

This application is also related to co-owned U.S. patent application Ser. No. 14/709,234 filed on May 11, 2015 and entitled "Power-Efficient Actuator Assemblies and Methods of Manufacture"; which is a divisional of and claims priority to co-owned U.S. patent application Ser. No. 13/149,508 filed on May 31, 2011 of the same title, now U.S. Pat. No. 9,027,903; which claims the benefit of priority to co-owned U.S. Provisional Patent Application Ser. No. 61/423,481 filed Dec. 15, 2010 of the same title, each of the foregoing incorporated herein by reference in its entirety.

This application is also related to co-owned U.S. patent application Ser. No. 14/671,823 filed on Mar. 27, 2015 and entitled "Memory Alloy-Actuated Apparatus"; which is a divisional of and claims priority to co-owned U.S. patent application Ser. No. 13/662,210 filed on Oct. 26, 2012 and entitled "Memory Alloy-Actuated Apparatus and Methods for Making and Using the Same"; which claims the benefit of priority to co-owned U.S. Provisional Patent Application Ser. No. 61/551,739 filed Oct. 26, 2011 of the same title, each of the foregoing incorporated herein by reference in its entirety.

This application is also related to co-owned U.S. patent application Ser. No. 12/969,143 filed on Dec. 15, 2010 and entitled "Memory Alloy-Actuated Apparatus and Methods for Making and Using the Same", the foregoing incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Technological Field

The present disclosure relates generally to the area of actuated or actuate-able components, such as e.g., those which relate to granting or denying access to a space, area, or container, and more specifically in one exemplary aspect to an improved design for and methods of manufacturing and using a hinge or pivot apparatus which is controlled and/or actuated by thermally or electrically activated filament(s), such as a shape memory alloy (SMA) material.

2. Description of Related Technology

Actuator assemblies are well known in a variety of industries, including such common applications such as wastewater treatment plants, power plants, manufacturing plants and refineries, as well as in certain consumer or residential devices. One common prior art apparatus for actuator-induced movement is a solenoid. A solenoid is a device that converts energy (e.g. electrical current, fluid pressure, etc.) into a linear actuation. An electromechanical solenoid typically comprises electrically conductive windings that are wrapped around a magnetic core. The windings produce a magnetic field when an electrical current is passed through it, thereby inducing the magnetic core to move. A pilot valve stem or other such parent apparatus is coupled to the magnet, thereby actuating a parent device. One exemplary application for solenoids is via the integrated use of a solenoid to actuate a lock or other such mechanism. Numerous examples of solenoid actuators exist in the prior art including, for example, U.S. Pat. No. 7,347,221 to Berger, et al. issued Mar. 25, 2008 and entitled "SOLENOID VALVE", incorporated herein by reference in its entirety.

Similarly, electromagnetic locks are commonly used to secure movement between components, such as between a door and a door jamb. An electromagnetic lock generally consists of an electromagnet and an armature plate. Electromagnetic locking devices can be for example either "fail safe" or "fail secure". As their names imply, fail-secure locking device remains locked when power is lost, while fail-safe locking devices are unlocked when de-energized. Typically, the electromagnet portion of the lock is attached to the door frame and a mating armature plate is attached to the door, rendering the two components in close proximity or even contact when the door is closed. When the electromagnet is energized, current passing through the electromagnet creates a magnetic flux that causes the armature plate to be attracted to the electromagnet, thereby providing the locking function. Through use of relatively large facial areas on each component, the force created by the magnetic flux is strong enough to keep the door locked even under significant force.

A common limitation with regards to electromechanical solenoids (particularly those that are used in small or portable consumer applications) is the fact that the actuating current is often generated via a series of batteries. Such batteries are often arranged in a series configuration, thereby adding the voltage of each cell while maintaining a common current through each. These solenoid actuators generally have comparatively large power requirements, and are often inefficient due to inter alia the internal resistance associated with the application of an electric current across the solenoid coils.

Similarly, electromagnetic locks typically require significant electric power sources, and when designed to operate in a "fail safe" mode, require constant application of such power to the device. Even for a small portable application such as referenced above, such power consumption can be very significant. Alternatively, when designed to operate in "fail secure" mode, access via whatever mechanism is secured (e.g., door, lid, etc.) is frustrated until power can be restored, which can have deleterious and even life-threatening consequences depending on the application.

Shaped Memory Alloy

Similarly, the use of thermally or electrically sensitive materials such as shaped memory alloy (SMA) for various purposes including device actuation is also well known. SMA generally comprises a metal that is capable of "remembering" or substantially reassuming a previous geometry or physical condition. For example, after it is deformed, it can either substantially regain its original geometry by itself during e.g., heating (i.e., the "one-way effect") or, at higher ambient temperatures, simply during unloading (so-called "pseudo-elasticity"). Some examples of shape memory alloys include nickel-titanium ("NiTi" or "Nitinol") alloys and copper-zinc-aluminum alloys.

SMAs often find particular utility in a variety of mechanical systems including, for example, U.S. Pat. No. 6,840,257 to Dario, et al. issued Jan. 11, 2005 and entitled "Proportional valve with shape memory alloy actuator"; U.S. Pat. No. 6,843,465 to Scott, issued Jan. 18, 2005 and entitled "Memory wire actuated control valve"; U.S. Pat. No. 7,055,793 to Biehl, et al., issued Jun. 6, 2006 and entitled "Valve with compact actuating mechanism"; and United States Patent Publication No. 20050005980, to Eberhardt, et al. published Jan. 13, 2005 and entitled "Multiway valve", each of the foregoing being incorporated herein by reference in its entirety.

See also the following U.S. Patents assigned to the Assignee of the present disclosure, each dealing with SMA apparatus and methods, each incorporated herein by reference in its entirety: U.S. Pat. No. 9,027,903 entitled "Power-efficient actuator assemblies and methods of manufacture", U.S. Pat. No. 8,946,934 entitled "Low-cost connector apparatus and methods for use in high-speed data applications", U.S. Pat. No. 8,939,180 entitled "Apparatus and methods for filament crimping and manufacturing", U.S. Pat. No. 8,851,443 entitled "Memory alloy-actuated apparatus and methods for making and using the same", U.S. Pat. No. 8,540,206 entitled "Multi-stable actuation apparatus and methods for making and using the same", U.S. Pat. No. 8,113,243 entitled "Apparatus and methods for filament crimping and manufacturing", U.S. Pat. No. 7,926,520 entitled "Apparatus and methods for filament crimping and manufacturing", and U.S. Pat. No. 7,650,914 entitled "Apparatus and methods for filament crimping and manufacturing".

Despite the foregoing wide variety of actuation approaches and configurations in the prior art, there remains an unsatisfied need for actuated/actuate-able components such as hinges or pivot apparatus and related methods that are: (1) spatially compact; (2) sufficiently rugged and robust from a mechanical standpoint, and (3) electrically power efficient, and which can take advantage of, inter alia, portable and/or renewable energy resources.

Moreover, it would be desirable to provide solutions (depending on the particular application contemplated) which could be either (i) proprietary in nature, so as to frustrate use of unapproved or surreptitious equipment and signals in order to try to defeat or bypass the functions of the hinge/pivot, and/or (ii) generic or "universal" in nature, so that a "smart" hinge or pivot could be readily adapted for use to a variety of different applications or uses, including use with extant container and solenoid technology.

SUMMARY

The present disclosure satisfies the aforementioned needs by providing, inter alia, an improved actuated or actuate-able pivot or hinge, and methods for manufacturing and using the same.

In a first aspect, a selectively accessible container apparatus is disclosed. In one embodiment, the selectively accessible container apparatus includes a container comprising a container lid; and a hinge assembly coupled to the container and the container lid, the hinge assembly including first and second outer housing elements configured to house a plurality of internal components therein. The plurality of internal components including a shape memory alloy (SMA) filament; a pull rod, the pull rod configured to be communicatively coupled with the SMA filament; an inner ratchet element and a complementary outer ratchet head, where upon activation of the SMA filament, the pull rod is configured to pull the inner ratchet element away from the complementary outer ratchet head, thereby enabling the container lid to be actuated with respect to the container; and a return spring configured to return the inner ratchet element so as to communicatively engage the complementary outer ratchet head upon deactivation of the SMA filament.

In one variant, the plurality of internal components further includes an SMA anchor plate having a printed circuit board, the SMA filament configured to be coupled to the SMA anchor plate, the SMA anchor plate configured to remain in a substantially fixed position within the hinge assembly.

In another variant, the printed circuit board further includes a logical component, the logical component configured to selectively enable activation of the SMA filament.

In yet another variant, the logical component is configured to receive a password or code, the password or code configured to enable the selective activation of the SMA filament.

In yet another variant, the plurality of internal components further includes a torsion spring, the torsion spring configured to provide a biasing force on the container lid thereby enabling automated opening of the container lid upon activation of the SMA filament.

In yet another variant, the inner ratchet element and the complementary outer ratchet head each include one or more teeth, the teeth when engaged frustrate the ability to rotate the container lid in a first direction while simultaneously permitting rotation of the container lid in a second direction.

In yet another variant, the first direction includes an opening direction for the container lid and the second direction includes a closing direction for the container lid.

In yet another variant, the plurality of internal components further includes a cushion spring, the cushion spring configured to mitigate stresses on the SMA filament during engagement of the teeth of the inner ratchet element and the complementary outer ratchet head.

In yet another variant, the cushion spring is further configured to allow a defined motion for the inner ratchet element without the translation of motion to the pull rod and the SMA filament.

In a second aspect, a hinge assembly is disclosed. In one embodiment, the hinge assembly includes an outer housing element, the outer housing element configured to house a plurality of internal components. The plurality of internal components includes a printed circuit board, the printed circuit board configured to be communicatively coupled with the outer housing element; a pivoting latch arm, the pivoting latch arm comprising a pivot point disposed between two opposing ends for the pivoting latch arm; a traveling rod that is actuated via the use of an SMA filament, the actuation of the traveling rod is configured to engage one of the two opposing ends of the pivoting latch arm. The other opposing end of the pivoting latch arm is configured to engage a respective feature located on a selectively accessible container.

In one variant, the hinge assembly further includes a return spring that is received concentrically around at least a portion of the traveling rod, the return spring configured to return the traveling rod to a non-actuated SMA filament position.

In another variant, the traveling rod, when in the non-actuated SMA filament position, is configured to lock the selectively accessible container.

In yet another variant, two ends of the SMA filament are configured to be held at an anchor point located within the outer housing element.

In yet another variant, an outer end of the traveling rod is configured to have the SMA filament routed around the outer end.

In yet another variant, the printed circuit board further includes a logical component, the logical component configured to selectively enable activation of the SMA filament.

In yet another variant, the logical component is configured to receive a password or code, the password or code configured to enable the selective activation of the SMA filament.

In yet another variant, the logical component is configured to receive an activation signal, the activation signal being generated in response to receipt of a password or code.

In a third aspect, an actuated pivot apparatus is disclosed. In one embodiment, the pivot apparatus includes: at least two components in substantial communication, at least one of the at least two components configured to move relative to another of the at least two components in a substantially rotational fashion; and control apparatus configured to selectively control the substantially rotational movement based on the application of an electrical signal.

In one variant, the pivot apparatus comprises a hinge, and the control apparatus comprises at least one shaped memory alloy (SMA) filament which is configured to alter at least one physical property upon the application of the electrical signal, the alteration of the at least one property enabling the selective control.

In one implementation, the hinge assembly includes a lockable hinge with the remote control operation capability provided by the SMA apparatus to latch and unlatch the hinge.

In a fourth aspect, an SMA-based actuator for use in, e.g., a pivot apparatus such as that referenced above, is disclosed. In one embodiment, the actuator comprises at least one thermally or electrically activated SMA filament which is used in conjunction with a ratchet-type rotational assembly and torsion spring so as to enable selective release of the rotational assembly so as to permit rotation of portions thereof.

In a fifth aspect, an actuator pivot module is disclosed. In one embodiment, the module includes a pivot (e.g., hinge) that is selectively mate-able to, and removable from, a host container or other apparatus. In one variant, the module is mounted to the container via externally inaccessible fasteners (e.g., screws, quick-release latches, etc.) so as to enable the module to be mounted to/removed from the container rapidly, yet frustrate removal by someone attempting surreptitious access to the interior volume of the container. In one implementation, the module contains its own electrical power supply and wireless communications suite.

In a sixth aspect, a method of manufacturing a hinge assembly is disclosed. In one embodiment, the method includes forming the components of the hinge assembly, and assembling the components in a prescribed sequence within the outer housing so that the SMA filament is at proper tension when the hinge is assembled.

In a seventh aspect, a method of using a hinge assembly is disclosed. In one embodiment, the method is configured to frustrate or prevent access to one or more enclosed volumes within a container. In another embodiment, the method is configured to frustrate or prevent egress of a person, animal, substance, or item from a closed or sealed container volume. In one variant, the prevention or frustration of egress includes creating a partial or limited pathway between the container volume and the exterior environment of the container so as to e.g., permit for interchange of air, substances, audible communications, etc. there between.

In yet another embodiment, the method includes remotely controlling the actuation of the hinge assembly such that selective access to the container or other host device to which the hinge is mounted is provided (or alternatively frustrated). In one variant, the method includes activating a sequence of hinges on respective individual containers at prescribed times such that known items (e.g., different pharmaceuticals) are accessible by a patient, so as to ensure a proper sequence and timing of pharmaceutical delivery. In another variant, the aforementioned hinge(s) is/are controlled by way of control logic which imposes one or more conditions precedent to the container such that it will not open (or alternatively close) until such conditions are met.

In an eighth aspect, a selectively actuated shipping element is disclosed. In one embodiment, the element comprises a container with lid, or other selectively closed volume, along with a logic-actuated hinge which allows for access to the volume only after certain conditions are met; e.g., the element has arrived at its destination, the integrity of the shipped item in the volume has not been violated, the intended recipient authenticates themselves to the container logic (or a remote entity such as a server in data communication with the element), etc.

In a ninth aspect, a method of providing selectable access to a container located at a first location is disclosed. In one embodiment, the method includes providing a hinge assembly, the provision of the hinge assembly including obtaining a plurality of components to form a hinge assembly for the container, the plurality of components comprising a circuit board having a logic component disposed thereon and an SMA filament; and inserting the circuit board having the logic component disposed thereon and the SMA filament into one or more housing portions for the hinge assembly. The method further includes causing the attachment of the hinge assembly to the container; causing the receipt of an activation signal at the hinge assembly at the first location, the activation signal generated at a second location, the second location being remote from the first location; and in response to receipt of the activation signal, causing the hinge assembly to open thereby providing access to contents located within the container.

In one variant, the method further includes providing the container having the hinge assembly attached thereto.

In another variant, the method further includes providing a standardized specification for the container, the standardized specification configured to enable the attachment of the hinge assembly to the container.

BRIEF DESCRIPTION OF THE DRAWINGS

The features, objectives, and advantages of the disclosure will become more apparent from the detailed description set forth below when taken in conjunction with the drawings, wherein.

Figure 1:
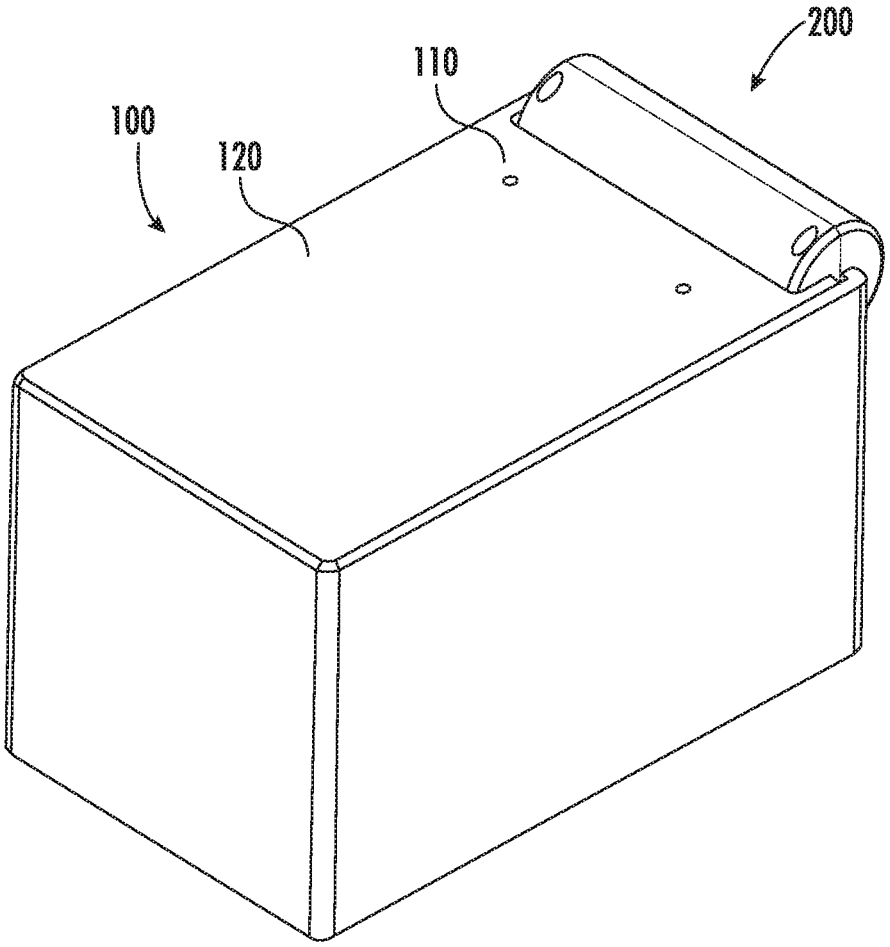
FIG. 1 is a top perspective view of an exemplary embodiment of a selectively closable container having a hinge assembly configured according to the present disclosure.

All Figures disclosed herein are © Copyright 2014-2015 Autosplice, Inc. All rights reserved.

DETAILED DESCRIPTION

Reference is now made to the drawings wherein like numerals refer to like parts throughout.

Overview

The present disclosure provides, inter alia, improved lockable and/or actuate-able pivot or hinge elements for use in a variety of applications, and methods for manufacturing and utilizing the same.

Specifically, in exemplary embodiments, the present disclosure provides solutions to end users for applications such as doors, box lids of dispensing systems (e.g., medical devices, pharmaceuticals, or instruments); lock or security boxes such as for tools, jewelry, etc., that are highly spatially compact, reliable, and which are highly power-efficient.

Such solutions also can provide the ability, when so configured, for remote control operation, such as via a wireless or wireline communications link from a remote entity and/or location, and/or operation from either internal or external control logic, such as a timer, accelerometer, gravitational and/or orientation sensor, or other such apparatus, hence providing "smart" hinge capability within a small, cost-effective, and power efficient form factor.

In an exemplary implementation, the foregoing capabilities are provided through use of one or more shape memory alloy (SMA) elements to e.g., latch and unlatch the hinge or pivot, through the selective application of electrical current or thermal energy.

In another exemplary implementation, the foregoing capability is provided via an aftermarket "smart hinge module" which can be utilized with extant container and actuator solutions in order to provide the benefits noted above.

Exemplary Embodiments

Detailed descriptions of the various embodiments of the apparatus and methods of the present disclosure are now provided. It will be appreciated that while described substantially in terms of apparatus or mechanisms which can grant or deny access or ingress/egress to or from an area, space or volume, such as hinges or pivots on doors or containers, the various features and aspects of the present disclosure are in no way so limited, and in fact may be readily adapted to numerous other applications by those of ordinary skill in the relevant arts when provided the present disclosure. For instance, the features described herein could be applied to any application where a particular angular relationship or series of angles between two components is required, such as e.g., vanes on a fan blade or wind turbine, position of a sensor relative to its mount, and so forth.

Moreover, it will be appreciated that the pivot or hinge apparatus described herein may be used to convert angular position or orientation to linear position or orientation, such as e.g., where the exemplary hinge apparatus is coupled to a linear (versus angular) transfer mechanism.

It will further be appreciated that the terms "stationary" and "moveable" as used in describing exemplary embodiments herein may merely connote a relative relationship between components; i.e., both components may move relative to an external frame of reference, the "moveable" component may in fact be stationary relative to the frame of reference while the "stationary" component moves, and so forth. Hence, these terms are in no way limiting on the applications, functions, or orientations of any devices or components described herein.

As used herein, the terms "electrical component" and "electronic component" are used interchangeably and refer to components adapted to provide some electrical or electronic function, including without limitation, fuses, transformers, filters, inductors, capacitors, resistors, operational amplifiers, transistors and diodes, whether discrete components or integrated circuits, whether alone or in combination. In addition, other ancillary electronic devices such as for example, so-called EMI shields and the like, which could be considered passive in nature, are considered encompassed as possibilities within the meaning of this term.

As used herein, the term "filament" refers to any substantially elongate body, form, strand, or collection of the foregoing, including without limitation drawn, extruded or stranded wires or fibers, whether metallic or otherwise.

As used herein, the term "pivot" includes, without limitation, hinges, ball joints, and/or any other mechanical apparatus which permits controlled motion of one or more components between two or more states or in two or more positions. Such states may be e.g., binary (e.g., "open" and "shut"), variable relative angles (e.g., 20 degree, 45 degrees, etc.), according to linear or non-linear scales, or yet other measures of position or displacement.

As used herein, the term "shape memory alloy" or "SMA" shall be understood to include, but not be limited to, any metal that is capable of "remembering" or substantially reassuming a previous geometry. For example, after it is deformed, it can either substantially regain its original geometry by itself during e.g., heating (i.e., the "one-way effect") or, at higher ambient temperatures, simply during unloading (so-called "pseudo-elasticity"). Some examples of shape memory alloys include nickel-titanium ("NiTi" or "Nitinol") alloys and copper-zinc-aluminum alloys.

As used herein, the term "wireless" means any wireless signal, data, communication, or other interface including without limitation Wi-Fi, Bluetooth, 3G (3GPP/3GPP2), FISDPA/HSUPA, TDMA, CDMA (e.g., IS-95A, WCDMA, etc.), FHSS, DSSS, GSM, PAN/802.15, WiMAX (802.16), 802.20, Zigbee, narrowband/FDMA, OFDM, PCS/DCS, LTE/LTE-A, analog cellular, CDPD, satellite systems, millimeter wave or microwave systems, acoustic, and infrared (i.e., IrDA).

Container and Hinge Assembly—

Referring now to FIG. 1, an exemplary embodiment of a lockable container or box 100 for use with a remote dispensing system is shown and described in detail. Specifically, the lockable box 100 includes a lid 120 that is coupled to a lockable hinge 200 by way of attachment holes 110. Lockable container 100 is for use with, inter alia, remote container or dispensing systems in order to provide, for example, a consumer with various goods including, without limitation, pharmaceuticals; pharmaceutical equipment (e.g., syringes); various tools or hardware; valuable items such as jewelry; shipped goods (e.g., in a sealed or temperature-controlled environment), or virtually any other type of item that can be utilized in conjunction with the remote dispensing systems and apparatus described herein.

As will be described in greater detail below, the lockable hinge 200 is advantageously suited for lower power consumption-based applications as compared with prior art solenoid-type lockable hinges or electromagnetic locks, as the lockable hinge is actuated via the use of, for example, a shape memory alloy (SMA) wire that is manufactured from, for example, nickel-titanium (NiTi) based alloys or copper-aluminum-nickel based alloys. While primarily discussed in the context of NiTi SMA wires, it is readily appreciated by one of ordinary skill in the SMA arts that the NiTi may be readily substituted with other alloy materials that "remembers" its original shape and that when deformed returns to its pre-deformed shape when heated by way of, for example, the provision of electrical current through the SMA wire, or direct application of thermal heat. These other SMA alloys include iron-based and copper-based SMA alloys such as iron-manganese-silicon; copper-zinc-aluminum; and copper-aluminum-zinc based alloys. However, generally speaking NiTi based SMAs are preferable for most applications due to their stability and generally superior thermo-mechanic performance based characteristics.

Figure 1A:
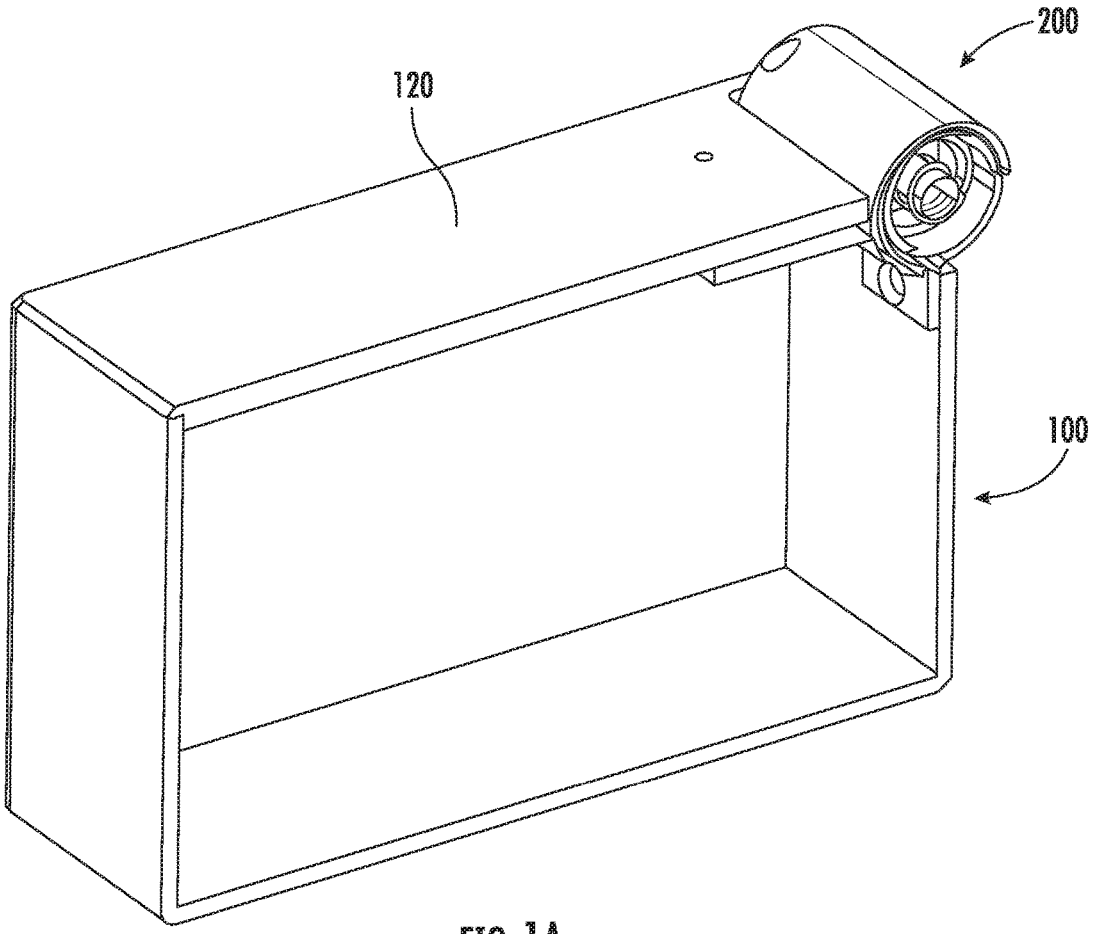
FIG. 1A is a cross-sectional view of the container of FIG. 1, taken along line 1A-1A thereof.

FIG. 1A is a cross-sectional view of the container of FIG. 1, taken along line 1A-1A thereof, showing the relationship of the hinge 200 to the container and lid. As shown, the hinge 200 is disposed so that the container lid 120 can fully articulate on the hinge (and as controlled by the hinge). Moreover, it will be appreciated that other locking mechanisms (not shown) may be used in conjunction with the hinge 200, such as at the opposite end of the container lid or along its edges, so as to provide additional rigidity to the container as a whole (and further frustrate surreptitious attempts at access such as prying the lid open from the non-hinged end). Such additional locking mechanisms, if used, may be controlled by the hinge 200 (whether by an integral mechanism which actuates to release or engage the lock when the hinge 200 is activated for release or closure, respectively, by its own SMA-based filament, or otherwise).

Figure 2A:
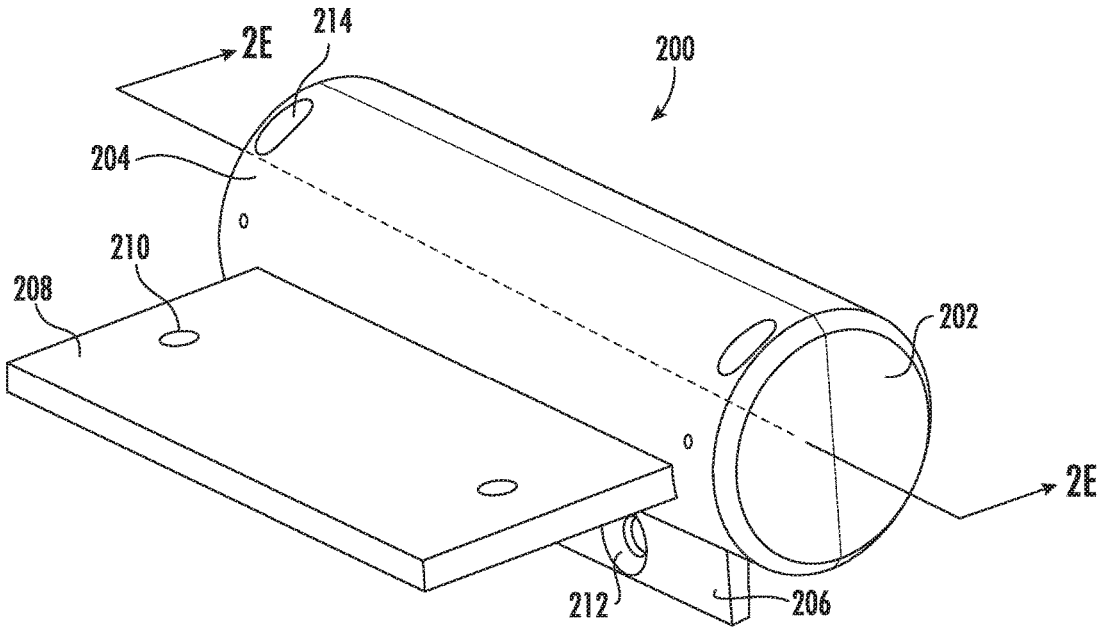
FIG. 2A is a top perspective view of the hinge assembly as shown in FIG. 1, removed from the container.

FIG. 2A is a top perspective view of the hinge assembly 200 as shown in FIG. 1, removed from the container. As shown in FIG. 2A, the hinge 200 includes first and second outer ("stationary") housing elements 202, 204 with associated mounting plate 206 (and mounting holes 212 formed therein), and a "moveable" hinge element 208 with mounting holes 210.

The two elements 202, 204 of the outer housing are mated together using e.g., threaded fasteners 214 as shown, although it will be appreciated that literally any type of fastener or mating agent may be used, including without limitation rivets, welds, brazing, adhesives, surrounding spring clips, etc., and/or combinations of the foregoing. In one alternate variant, the outer enclosure elements 202, 204 are substantially sealed with no accessible fasteners so as to frustrate any attempts to disassemble the hinge assembly 200 to gain access to the interior components thereof (and hence ultimately the interior of the container).

Figure 2B:
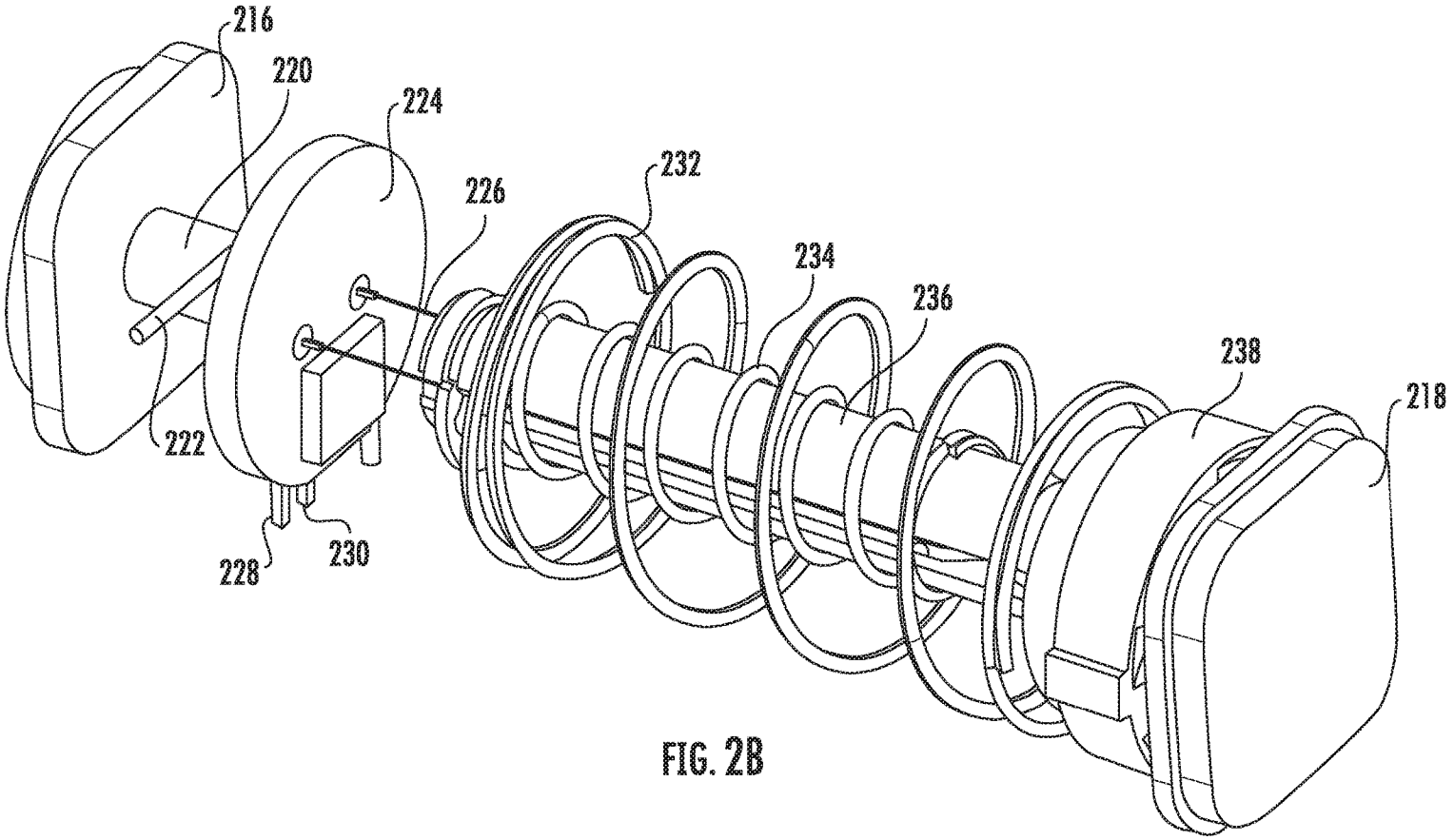
FIG. 2B is a perspective view of the hinge assembly of FIG. 2A, with internal components exposed.

FIG. 2B is a perspective view of the hinge assembly 200 of FIG. 2A, with internal components exposed. As shown, the internal components in this embodiment include an SMA filament 226, a cushion spring 232, a return spring 234, a central travelling "pull" rod 236, an inner (moving) toothed ratchet element 238, a complementary (outer) toothed ratchet head mounted on an end cap 218, an SMA anchor plate 224 with mounted PCB; electrical connection terminals 228, 230, a torsion spring 222, a second end cap 216, and a cylindrical protruding portion 220 located on the second end cap 216.

As shown, a single SMA filament 226 is utilized, and is routed through an aperture and bearing surface of the travelling rod 236 (see FIG. 2D) so as to permit anchoring of both the free ends of the filament 236 to the anchor plate 224. This approach advantageously makes use of a single filament (enhancing both uniformity of performance and reliability as compared to e.g., two separate filaments), although it will be appreciated that other arrangements may be utilized as desired (including use of two or more discrete filaments).

As will be described in greater detail below, the end caps 216, 218 are mounted into the outer housing 202, 204 of the hinge assembly 200 so that they are substantially stationary with respect to the outer housing (and the hinge plate 208 attached thereto). The rotating or moveable hinge element 206 fits substantially inside the outer elements, and rotates with respect thereto.

Figure 2C:
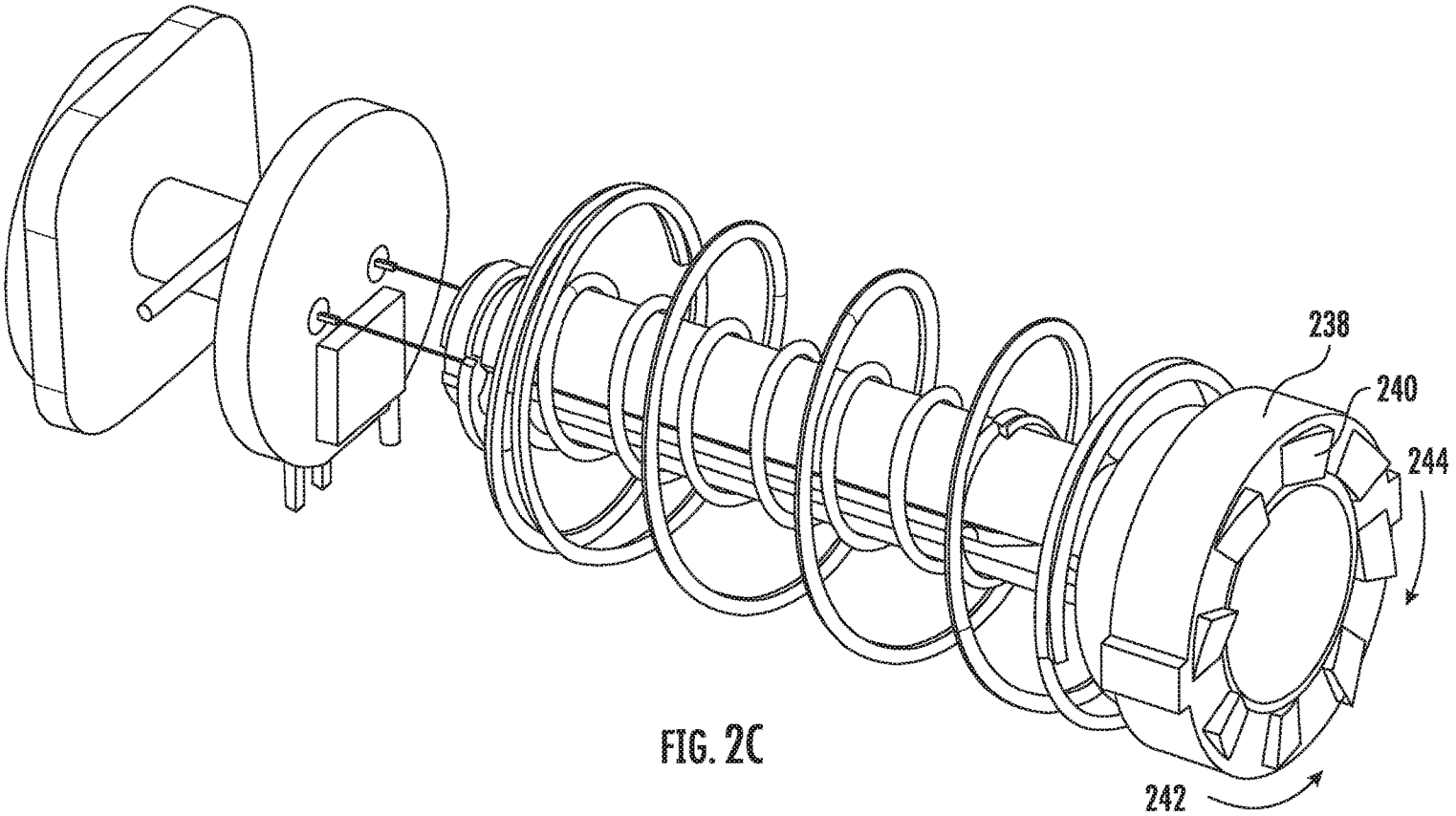
FIG. 2C is a perspective view of the hinge assembly of FIG. 2A, with internal components exposed and showing inner ratchet element configuration, placement and operation.

FIG. 2C is a perspective view of the hinge assembly of FIG. 2A, with internal components exposed and showing the inner (moving) ratchet element 238 configuration, placement and operation. As shown, the inner element 238 comprises a plurality of ratchet teeth 240 disposed on its mating face. The element is free to rotate in either direction 242, 244 as shown on the spindle disposed on the end of the travelling pull rod 236. The outer periphery of the inner ratchet element 238 includes in the illustrated embodiment a plurality of eccentric shapes (here, "keys") which fit into complementary grooves formed in the rotating hinge element 206. In this fashion, the inner ratchet element 238 rotates in unison with the hinge element 206 when the teeth 240 are disengaged from complementary ones of teeth on the outer (stationary) ratchet element 218 (see FIG. 2D), while the pull rod 236 does not rotate (and hence maintains a constant orientation) with respect to the SMA anchor plate 224.

Figure 2D:
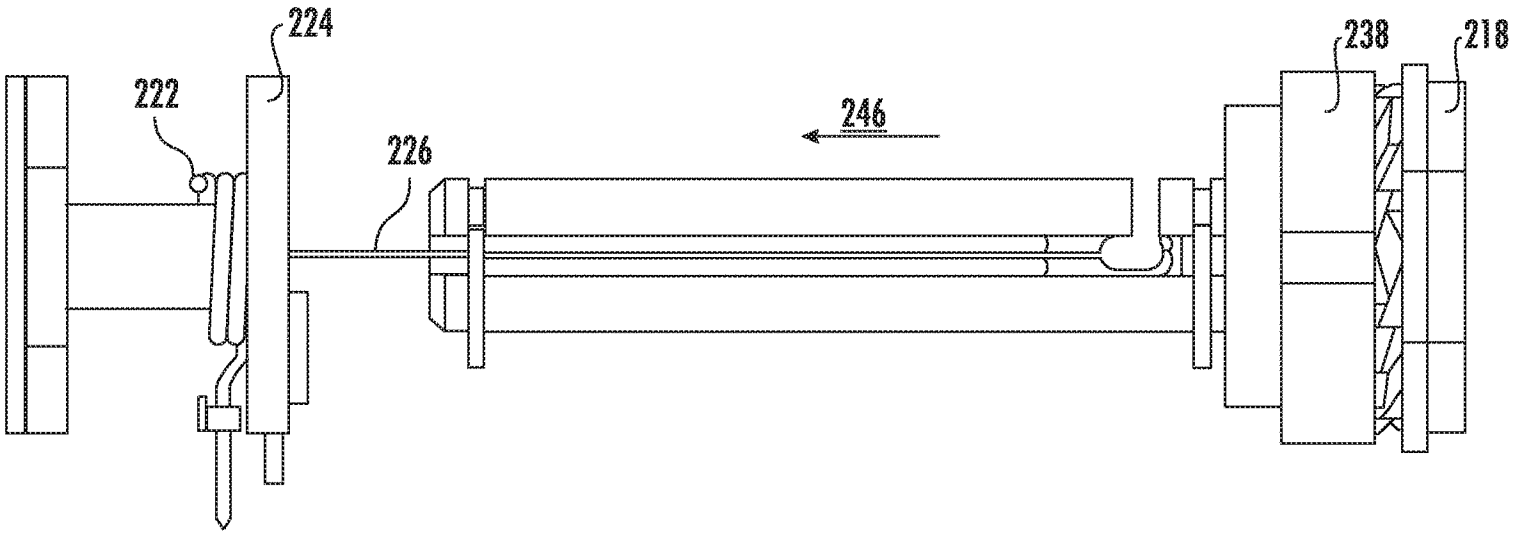
FIG. 2D is a side elevation view of the hinge assembly of FIG. 2A, with internal components exposed.

FIG. 2D is a side elevation view of the hinge assembly of FIG. 2A, with internal components exposed, showing the relationship of the inner and outer ratchet elements 238, 218. As shown in FIG. 2D (shown with inner and outer ratchet elements engaged to one another), the coupling of the inner and outer ratchet elements 238, 218 prevents the inner ratchet element 238 from rotating in the non-desired direction (e.g., corresponding to the moveable element 206 of the hinge moving to allow the container to open), effectively locking the container shut. The inner element can rotate in the desired direction (e.g., to further close/seal the container) only in this particular embodiment, although it will be appreciated that e.g., a non-ratcheted configuration may be used to freeze the hinge movement in both rotational directions if desired.

As shown by arrow 246 in FIG. 2D, upon actuation of the SMA filament (e.g., heating via electrical current, ambient temperature increase over time, incident exposure to IR radiation, etc.), the filament contracts and pulls the traveling pull rod 236 toward the anchor plate 224, compressing the return spring 234 (FIG. 2B), and disengaging the inner (moving) ratchet element 238 from the outer element 218, and hence freeing the movable hinge element 206 (which is coupled to the inner element 238 by the keys/slots) to rotate in either direction. Hence, when the SMA filament is activated, the user can freely open and close the lid 120 on the exemplary container 100. When the SMA filament is deactivated, the return spring 234 forces the rod 236 and inner element 238 back into engagement with the outer element 218, thereby again invoking the aforementioned "ratchet" function (i.e., movable in close direction only).

Also shown in FIG. 2D is the torsion spring 222, which acts in this particular implementation to bias the moveable hinge element 208 in the "open" direction when the inner ratchet element 238 is disengaged from the outer element 218 as discussed supra. Hence, in an exemplary pharmaceutical container application, the lid 120 would in effect "pop open" for the user when the SMA filament is actuated (e.g., when it is time to ingest the pharmaceutical). It is appreciated, however, that the torsion spring is merely optional, and in fact it may not be desirable to have the lid 120 of the container pop open upon SMA actuation in some applications, such as for example to prevent ingress of unwanted substances (e.g., dust, moisture, insects, contaminants, etc.).

Figure 2E:
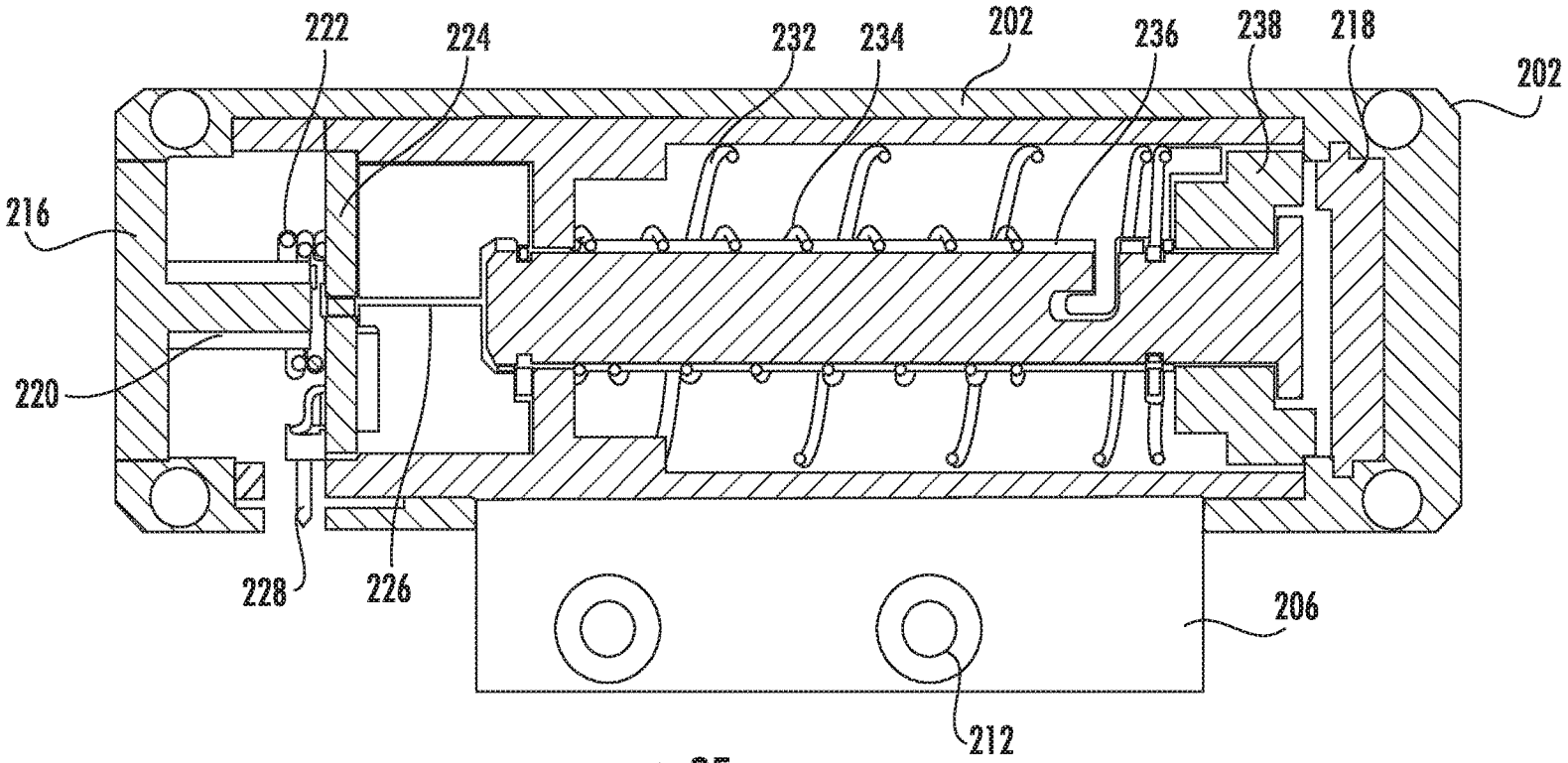
FIG. 2E is a cross-sectional view of the hinge assembly of FIG. 2A, taken along line 2E-2E thereof.

FIG. 2E is a cross-sectional view of the hinge assembly of FIG. 2A, taken along line 2E-2E thereof, showing each of the foregoing components collectively. As shown, the outer (stationary) ratchet element 218 and second end cap 216 are received within respective portions of the outer housing elements 202, 204 so as to maintain them stationary with respect thereto. The moveable hinge element 206 rotates concentrically within the outer housing elements 202, 204, around inter alia, the anchor plate 224 and the travelling rod 236, and in tandem with the inner moving ratchet element 238 by virtue of the aforementioned key/slot arrangement. The torsion spring is positioned about a cylindrical protruding portion 220 located on the second end cap 216.

The cushion spring 232 is disposed exterior to and concentric with the return spring 234; the cushion spring functions to mitigate stresses on the SMA filament during ratchet teeth engagement.

The cushion spring allows for the small motion of ratchet element 238 without translating this motion to the traveling rod 236 and SMA filament 226. This small axial motion protects the SMA filament from stress spikes that can be caused during actuation (application of electrical power) to the hinge assembly 200.

The electrical connection terminals 228, 230 are configured in the exemplary embodiment to receive electrical power (e.g., from a connected battery or other power source) for application to the SMA filament(s) 226, under control of the control logic. In one embodiment, the PCB mounted on the anchor plate 224 comprises electronic components and logic (e.g., one or more integrated circuits (ICs) and discrete electrical components such as capacitors, resistors, inductors, wiring traces, etc. in support of, e.g., the operation of the ICs) which selectively applies the electrical power received via the terminals 228, 230 to the SMA filament 226 when desired by the operator or other controller.

It is noted that the aforementioned logic can be implemented in any number of different ways and using any number of different architectures. For example, the logic may be completely self-contained, such as where the ICs include a programmable microcontroller or FPGA, and associated software/firmware, which enable the hinge device 200 to operate substantially autonomously as dictated by the programmed software/firmware; e.g., actuate the SMA filament at a prescribed time of day, when ambient temperature reaches a prescribed value as determined by an associated thermocouple or RTD, when exposed (or alternatively when no longer exposed) to ambient visible light as determined by an associated optical-band or IR sensor, when scanned by a laser bar code scanner indicating delivery at destination, and so forth.

Alternatively (or in conjunction with the foregoing), the apparatus may be configured such that external signaling can be applied to invoke various functions of the hinge apparatus 200. For example, in one embodiment, the aforementioned logic includes one or more integrated circuits capable of wireless communication with an external transmitter, such as via ISM-band frequencies, Bluetooth PAN, Wi-Fi LAN, infrared (e.g., IrDA), cellular, RFID/NFC, or yet other modality, such that the hinge apparatus 200 can be operated by an external radio frequency signal of the prescribed frequency and encoding the prescribed operational command(s). The command(s) may be for example to activate the SMA filament to actuate the hinge (e.g., open container, or lock it), and/or invoke other behavior such as opening at a future time, transmit information back to the external transmitter (e.g., data from sensors contained within the container volume, such as temperature, pressure, ambient light intensity, accelerometer output, GPS receiver ephemeris or other data, detected ionizing radiation, etc.), wakeup for a "sleep" mode of operation, battery status (if so equipped), etc.

In another variant, signaling (whether to the hinge assembly 200, from the assembly 200, or both) is carried over the electrical power terminals 228, 230 in addition to the electrical power. For instance, in one variant, the electrical power signals are modulated in amplitude/voltage to encode data or commands which is "picked off" the terminal by logic within the hinge 200. In another variant, a carrier wave is imposed onto one or both of the terminals at a prescribed frequency, and modulated so as to encode data/command signals. As yet another alternative, a separate data bus or terminal can be utilized to transfer signaling data, commands, etc. to and from the circuitry of the hinge assembly 200.

In another embodiment of the hinge assembly of the present disclosure, the electrical power (and optionally signal) connector is replaced or supplemented with an inductive power source, such as those known in the electrical arts for e.g., charging portable devices such as smartphones or tablets inductively. In one such implementation, the actuator assembly is configured to operate in a "fail-secure" mode (i.e., maintain host container shut and inaccessible) until (i) the appropriate control logic is applied (e.g., conditions necessary to open the container have been met, examples of which are described below), and (ii) the appropriate electrical power is available to cause activation of the SMA filament(s) by way of application of electrical potential/current.

It is also recognized that the power supply can be made proprietary in nature, such as e.g., through use of a proprietary electrical connector (see FIG. 3C), inductive interface, and even signaling across the physical or inductive interface (either on the applied electrical power voltage waveform or a separate communication or signaling channel or bus) such that only approved connectors/inductive devices/controllers can access the actuator logic so as to enable power to be applied to the SMA filament(s) and open/lock the container. For instance, if the applied inductive charge does not encode the proper proprietary or encryption sequence ("key"), the logic of the hinge assembly will not enable the container to be opened, irrespective of the presence of a valid "open" or "unlock" command or condition precedent to open/unlock. In this fashion, the hinge assembly ensures that it will only open when approved and/or "authenticated" equipment is used.

In yet another variant, the actuator is configured with a thermally-activated SMA filament, such that the hinge or pivot cannot be actuated until the appropriate ambient or other temperature is applied. For instance, in one implementation, the container remains locked until the container is placed in a suitably high-temperature environment such that sufficient heat is available to heat the filament and enable actuation of the hinge.

Conversely, in a further implementation, the container remains sealed (e.g., by way of the thermally "activated" SMA filament maintaining a bias on the appropriate actuator component until it is deactivated) until the container is placed in a suitably cold environment (such as a freezer or refrigerator) so as to frustrate spoilage due to e.g., opening before refrigeration is available.

In yet another variant, the control logic is configured to receive one or more inputs from e.g., internal and/or external sensors associated with the payload or contents of the container. For instance, it is well known to use sensors in shipping containers (which can also be accessed remotely) so as to indicate if a container has maintained a desired temperature profile, has been tampered with, etc. However, it may also be desirable in certain cases to further restrict access to the contents of the container if one or more metrics or required parameters has been violated, such as during transfer. Such metrics or parameters may be related for example to the viability or safety hazards of the contained items(s), such as where a perishable item has exceeded its safety temperature "profile" for an unacceptable period of time (and hence is unsafe for use/consumption), a hazardous agent has experienced a rupture or loss of integrity of its (internal) container (and hence could expose the opening user to a chemical, explosive, or biohazard or the like), the container as a whole has experienced too many "g's" or excessive shock due to e.g., being dropped or mishandled during shipping, etc.

Modular Hinge Assembly—

Figure 3:
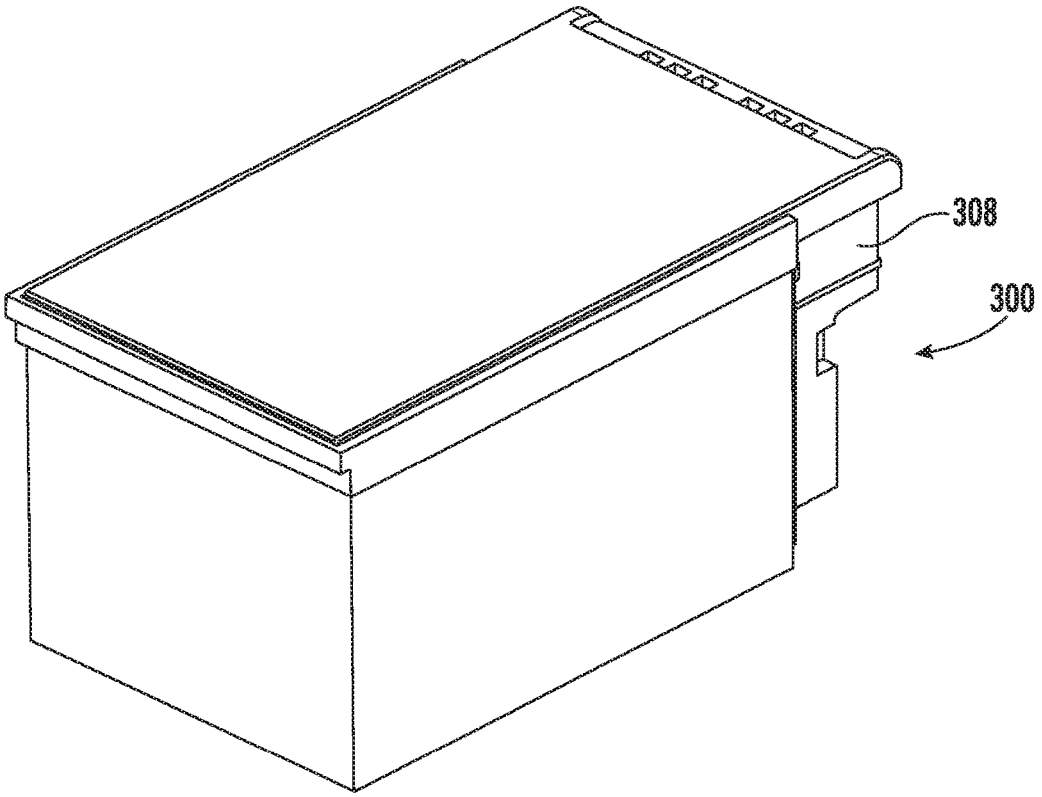
FIG. 3 is a side perspective view of an exemplary embodiment of a removable modular SMA hinge and actuation unit, shown attached to a typical container.

FIG. 3 is a side perspective view of another exemplary embodiment of a selectively closable container having a hinge assembly configured according to the present disclosure, including a removable modular SMA hinge and actuation unit 300. As shown in FIG. 3 (and subsequent FIGS. 3A and 3B), the modular hinge unit 300 is attached to the box and lid via attachment points 302 for fasteners on both the front (non-exposed) face 304 and top plate 306, respectively. Unlike the embodiment of FIG. 1, the SMA module 300 is not integral to the box itself, and is removable from its mounting location on the exterior of the box. Hence, it can be readily adapted to various extant box configurations by merely fastening it to the outside of the box. It is appreciated that while an extended lid is shown in the illustrated embodiment (so as to facilitate mating with the top plate 306), the top plate 306 may in fact be extended further over the top of the box so as to make use of an extant lid sized for the box. While the hinge assembly 200 of FIG. 2A illustrates one configuration (cylindrical shape) that has the lock inside of rotational axis that it is preventing rotation directly, the embodiment of FIG. 3 illustrates a second configuration (box shape) with the lock positioned close to the rotational axis. While the cylindrical shape configuration is more compact, the box configuration has advantages such as adapting to the different locking compartments to accommodate a modular approach.

Figure 3A:
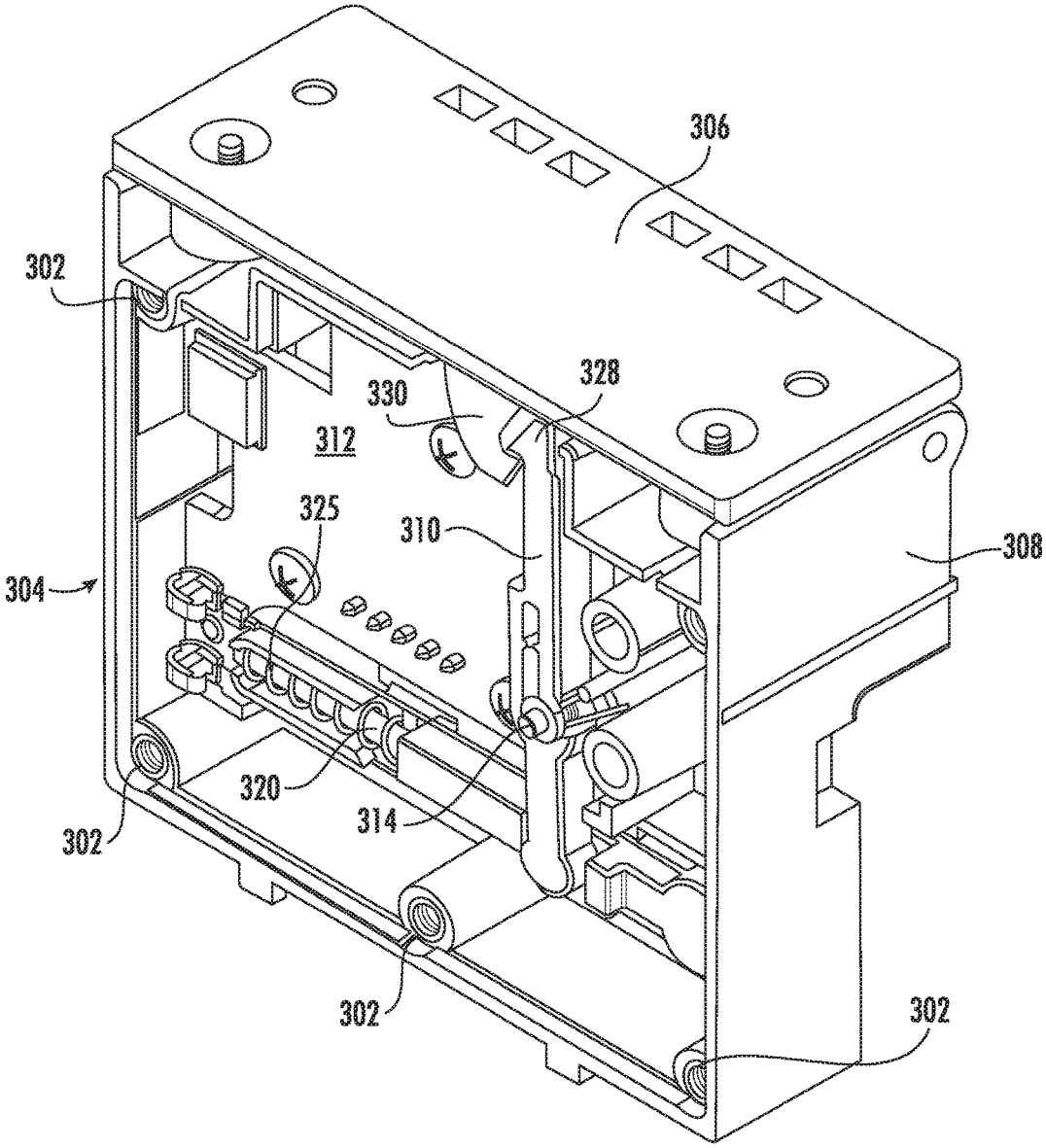
FIG. 3A is a side perspective view of the exemplary removable modular SMA hinge and actuation unit of the embodiment of FIG. 3.

FIG. 3A is a side perspective transparent view of the exemplary removable modular SMA hinge and actuation unit 300 of the embodiment of FIG. 3, removed from the host container box.

Figure 3B:
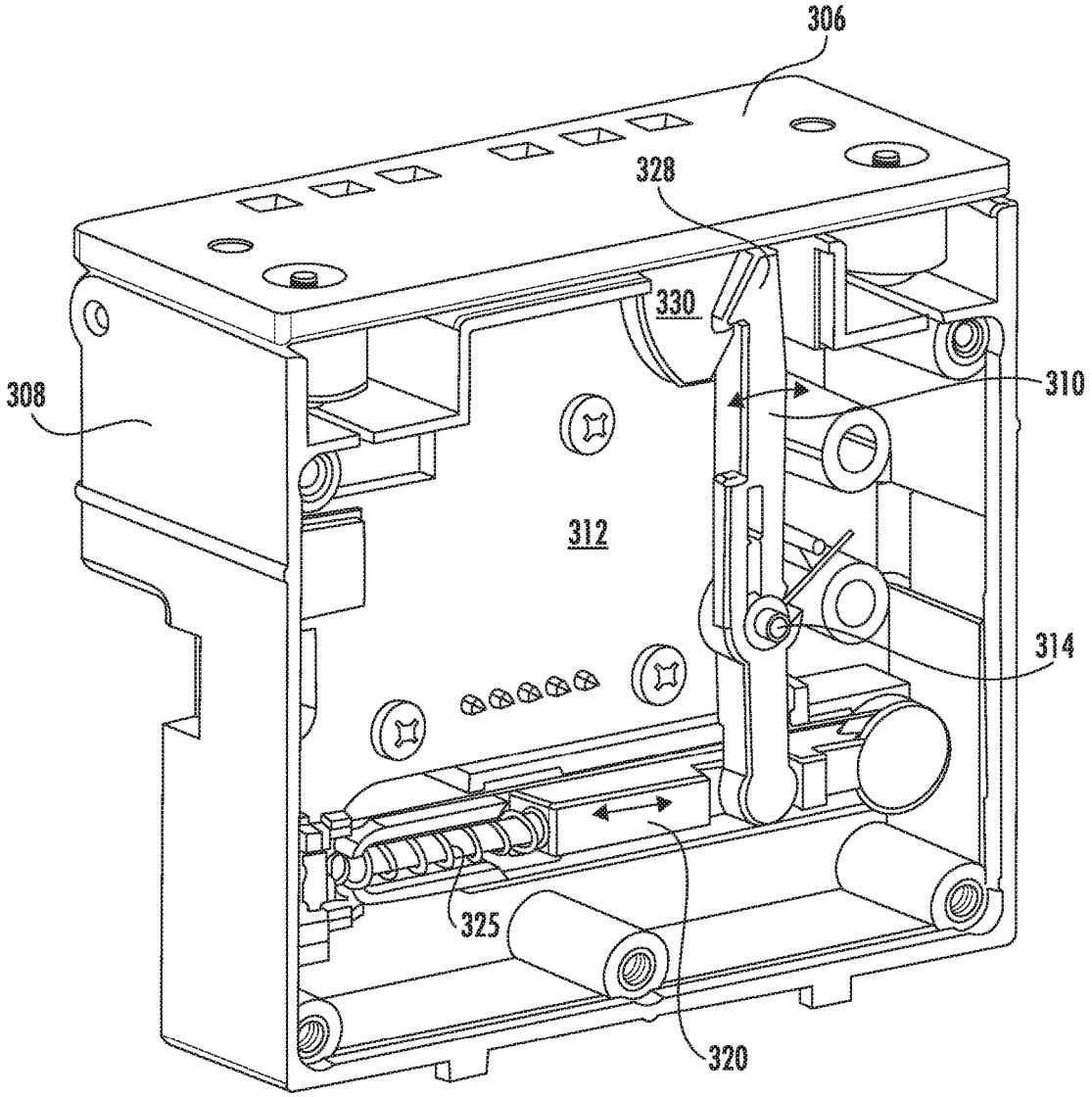
FIG. 3B is a side perspective view of the exemplary removable modular SMA hinge and actuation unit of the embodiment of FIG. 3.
Figure 3C:
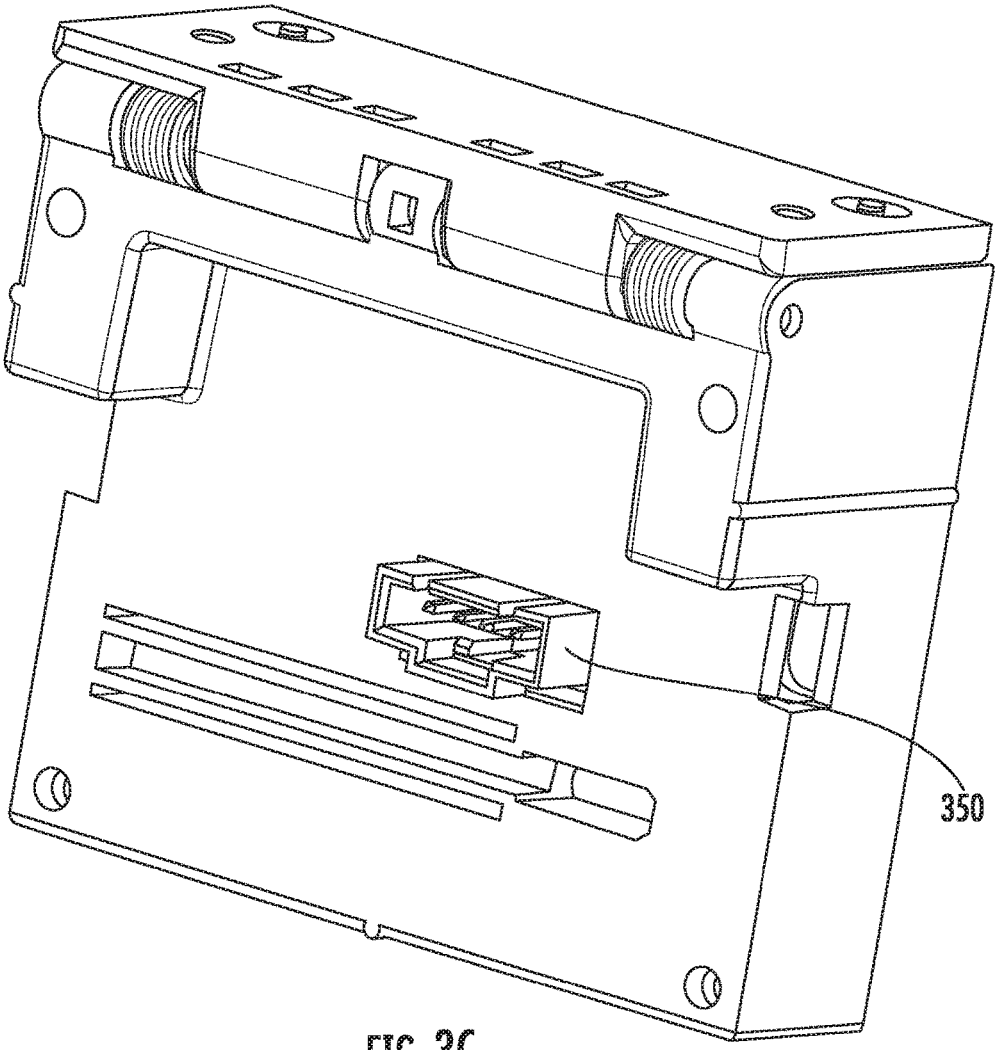
FIG. 3C is a rear perspective view of the exemplary removable modular SMA hinge and actuation unit of the embodiment of FIG. 3 illustrating provision of a connector.

FIG. 3B is also a side perspective view of the exemplary removable modular SMA hinge and actuation unit of the embodiment of FIG. 3A. As shown in FIG. 3B, the SMA module 300 includes an outer housing 308, pivoting latch arm 310, and interior printed circuit board (PCB) 312 with a pivot point 314 for the latch arm. A travelling rod 320 is pulled by an SMA filament 322, and biased in the other (deactivated) direction by a return spring 325 which surrounds a portion of the rod 320 concentrically. When the rod 320 is pulled and dislocated by the SMA filament 322, the latch arm 310 pivots around the pivot point, and the latch arm dog 328 is disengaged from a corresponding latch feature 330 formed into the underside of the top plate 306 as shown. The lid of the associated container may then be opened. It will be appreciated, however, that a "fail secure" configuration may also be used; e.g., the dog 328 is engaged upon activation of the SMA filament, thereby locking the lid. In the illustrated configuration, the PCB 312 comprises electronic components and logic (e.g., one or more integrated circuits (ICs) and discrete electrical components such as capacitors, resistors, inductors, wiring traces, etc. in support of, e.g., the operation of the ICs) in order to, inter alia, detect a wireless signal from an external wireless system so as to enable the actuation portion of the selectively closable container 300 having a hinge assembly. The PCB also includes a battery (not shown) to activate the unit or alternatively, it has a provision/connector 350 on the back side to transfer the signal/power to the unit (See FIG. 3C).

The fasteners within the attachment points 302 are also shown in FIG. 3B; as noted previously, while threaded screws are shown, myriad other types of fasteners may be used with equal success. In cases where it is desired that the module 300 be removable from the host container, non-fixed fasteners such as rivets, welds, etc. should generally be avoided so as to facilitate such removability.

In yet another embodiment, the modular SMA unit is configured for use with an off-the-shelf container, door, or other apparatus requiring a hinge or pivot that uses one or more other types of actuating mechanisms (e.g., a solenoid), in generally similar fashion to the methods and apparatus described in U.S. Pat. No. 9,027,903 entitled "Power-efficient actuator assemblies and methods of manufacture", assigned to the Assignee hereof and previously incorporated herein. Specifically, the module is configured to be a "drop in" for the extant solenoid or other actuator (including fitting within the prescribed space allocated for the solenoid or other extant actuator, being capable of utilizing the extant power supply voltage/current, or carrying its own autonomous power supply such as a battery or solar cell or inductive power interface), the drop-in SMA module being more spatially compact, lighter in weight, and more power efficient than the solenoid or other prior art actuator module, hence warranting the cost of retrofit. Accordingly, users of such extant actuators in applications can benefit by not having to replace their entire container, door, etc. infrastructure or apparatus, but rather can merely retrofit their apparatus with the drop-in SMA module, and realize all the aforementioned benefits thereof in an economical fashion.

As previously noted, the exemplary hinge assemblies described herein may be used with any number of different applications which require a pivot of one component with respect to one or more other components. As yet another example, the apparatus described herein may be used for controlling the position of ventilation components or dampers, including doors, windows, etc. in a residence or dwelling. In one such variant, the SMA-based hinges are mated to ventilation system flow dampers within the premises, such that the system can be dynamically balanced. Most traditional systems (especially lower cost installations such as residences) utilize static dampers and ventilation grates to balance the system (i.e., allocate flow between different regions within the system or rooms in the dwelling). This is typically done periodically, with the dampers/grates being positioned according to the then-determined flows of air. However, based on factors such as solar exposure, air density, open/closed doors, use or lack of use of a given space, and so forth, it may be desirable to dynamically reposition the dampers/grates so as to optimize one or more desired parameters (e.g., increase cooling flow to a hot room, etc.). The exemplary SMA hinges described herein can be configured so that upon input or command from e.g., a system controller, or even a user remote (which can include a user portable device such as a smartphone with application software running thereon), the system can reconfigure one or more damper/grate positions so as to achieve the desired result or optimization. Such reconfigurations can be substantially binary (e.g., damper/grate open, damper/grate shut), or more linear or graduated (e.g., 5 degrees open, 10 degrees open, etc.), the latter making use for example of the toothed ratchet elements 238, 218 of the device of FIG. 2 herein, such as where the SMA filament is activated only for a short period to allow the damper/grate to move by only a prescribed amount of rotation.

It will also be appreciated that while not shown, two or more hinge or pivot assemblies can be used in tandem (e.g., to support the weight of a door or heavier actuated component or object), or even opposition to one another (e.g., one biased to flip the lid of a container open, and one biased to flip the lid shut). Myriad other such combinations and configurations are contemplated by the present disclosure, such combinations and configurations readily implemented by those of ordinary skill given the present disclosure.

Exemplary Method of Manufacture—

Figure 4:
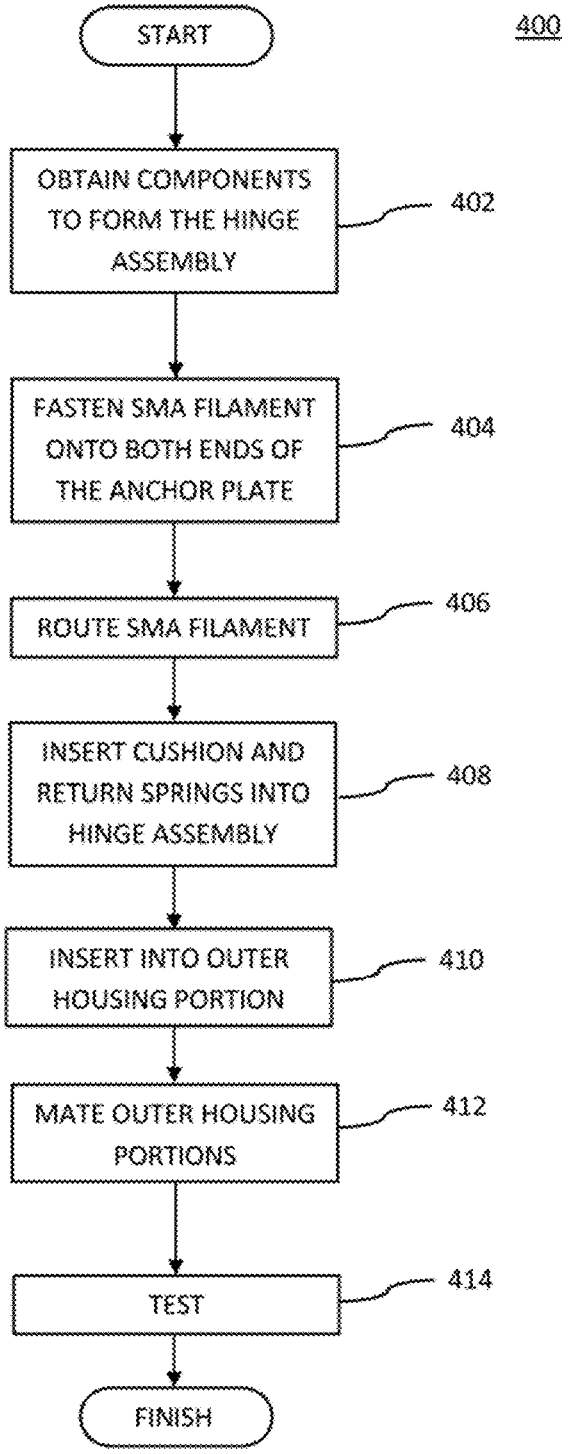
FIG. 4 is a logical flow diagram showing one exemplary embodiment of a method of manufacturing the hinge assembly of FIG. 2A.

FIG. 4 is a logical flow diagram showing one exemplary embodiment of a method 400 of manufacturing the hinge assembly 200 of FIG. 2A. As shown, the first step 402 includes obtaining the necessary components to form the hinge assembly 200. These components are shown in FIGS. 2A-2E herein.

Next, per step 404, the SMA filament 226 is fastened on both ends to the anchor plate 224, such as via welding, brazing, or even crimping, such as e.g., using the methods and apparatus described in U.S. Pat. No. 7,650,914 entitled "Apparatus and methods for filament crimping and manufacturing" assigned to the Assignee hereof and previously incorporated herein, although it will be recognized that other types of crimping, and in fact other types of fastening, may be used consistent with the present disclosure.

Next, per step 406, the "loop" portion of the SMA filament 226 is routed through the opening and onto the bearing surface of the traveling pull rod 236 as shown in FIGS. 2A-2E.

Per step 408, the cushion and return springs are then placed around the rod 236, the inner moving ratchet element 238 placed onto the rod end with keys/slots engaged.

Per step 410, and the entire assembly (including anchor plate 224 with PCB and electrical terminals 228, 230) placed into the open outer housing portion 202 within the movable hinge element 206 and along with the torsion spring 222 such that the teeth 240 of the ratchet element 238 engage those of the outer (stationary) ratchet element 218, the latter installed (along with the second end element 216) within their respective recesses in the housing, and the movable element 206 can rotate within the outer housing and be biased in the rotational direction by the torsion spring 222.

Lastly, per step 412, the outer housing elements 202, 204 are mated to one another and fastened together, and the entire assembly tested per step 414.

Alternate Container Embodiments—

Figure 5:
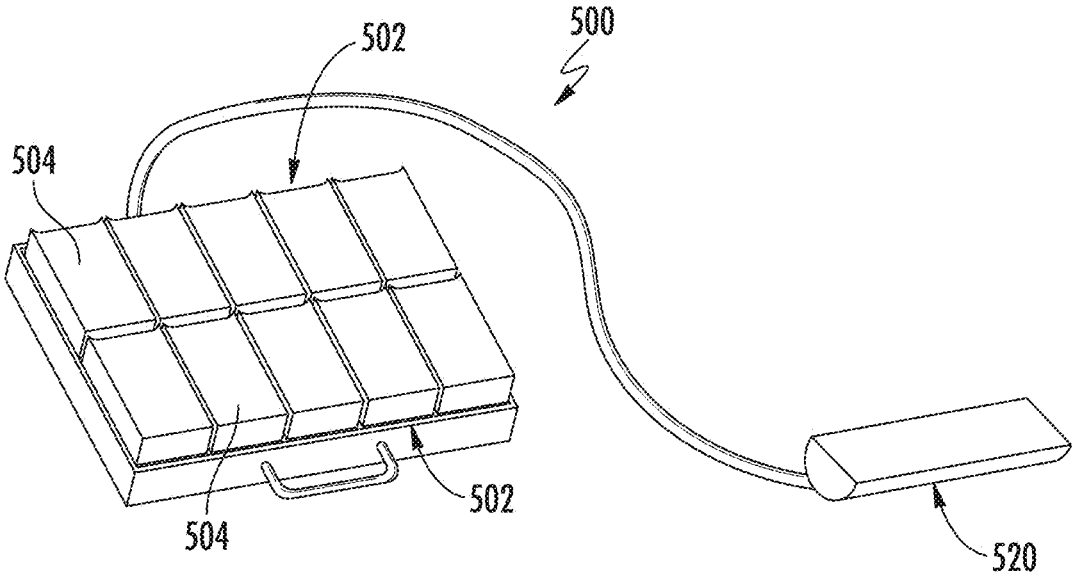
FIG. 5 is a top perspective view of another exemplary embodiment of a selectively closable container having a hinge assembly configured according to the present disclosure, including a wired (or wireless) remote control.
Figure 6:
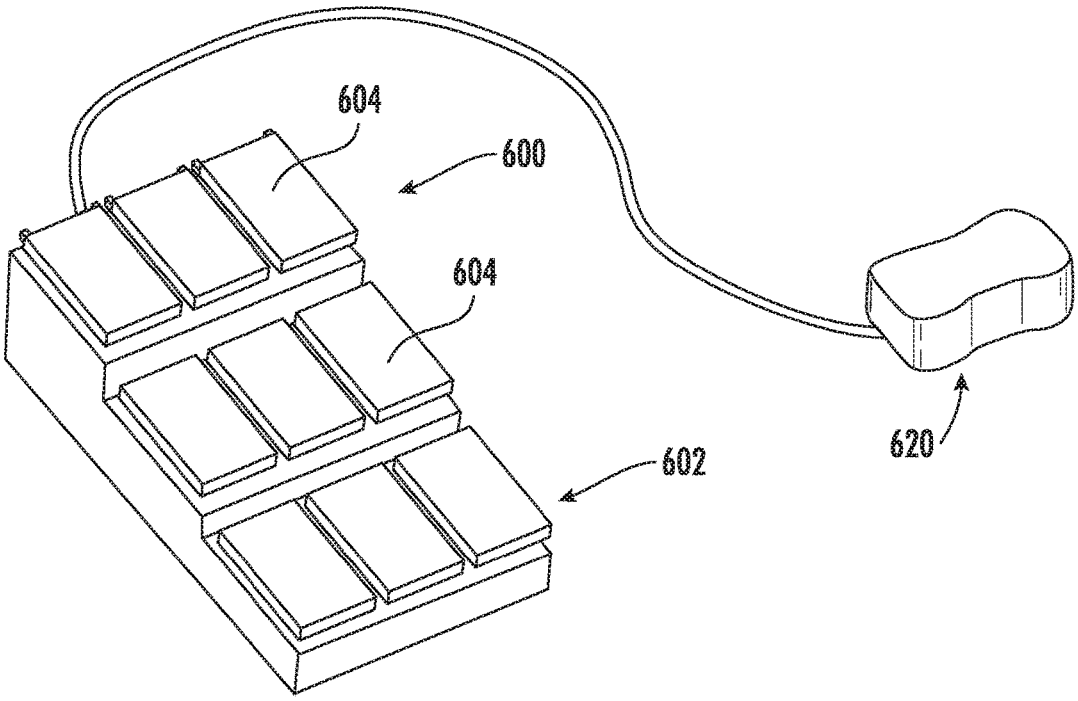
FIG. 6 is a top perspective view of yet another exemplary embodiment of a selectively closable container having a hinge assembly configured according to the present disclosure, including a wired (or wireless) remote control.

FIGS. 5 and 6 are top perspective views of yet other exemplary embodiments of a selectively closable container having a hinge assembly configured according to the present disclosure, including a remote control 520, 620. As shown in FIGS. 5 and 6, the containers 500, 600 each include a plurality of individually sealable compartments 502, 602 with lids 504, 604, each compartment having its lid individually controlled by an SMA-based hinge of the type described herein. These remote controls will, in an exemplary embodiment, include logic that enables a user to enter a password or code in order to enable access to the individual compartments. For example, these individual compartments might be used for, inter alia, timed or sequential dispensing of pharmaceuticals to patients, selective multiple user access (e.g., User A only granted access to Compartment A, User B granted access to Compartments A & B, or any other such permutations), vending applications (e.g., based on a user's selection, the appropriate compartment or compartments open to dispense a pharmaceutical, food item, toiletry, etc.).

It is further appreciated that while the illustrated exemplars include a wired connection to the controller 520, 620, the present disclosure contemplates use of a wireless interface between a controller (not shown) such as e.g., a wireless enabled smartphone or tablet, PDA, or other portable device, a desktop or laptop computer, etc., so that inputs and control of the containers 500, 600 can be effected wirelessly, and even remotely. For instance, in one exemplary implementation, the containers 500, 600 each include cellular (3G or 4G/LTE or LTE-A) interfaces which enable the containers to communicate with a distant entity via a cellular network. Alternatively, the containers may include a Wi-Fi (e.g., IEEE 802.11 a/b/g/n of the like) interface to permit the container to communicate with a local AP, such as a Wi-Fi node in a user's residence where the container is situated. The AP may be in wired/wireless connectivity with the Internet (such as via DOCSIS, DSL, cellular, etc. modem), over which the remote entity (e.g., doctor's office, shipping carrier, or centralized monitoring/administration center) can transmit commands to the containers, and optionally receive data and/or communications back from the containers. Hence, it is appreciated that the containers 500, 600 can have any desired degree of "intelligence" and capability consistent with the desired functions provided thereby.

It will be appreciated that while certain steps and aspects of the various methods and apparatus described herein may be performed by a human being, the disclosed aspects and individual methods and apparatus are generally computerized/computer-implemented. Computerized apparatus and methods may be necessary to fully implement these aspects for any number of reasons including, without limitation, commercial viability, practicality, and even feasibility (i.e., certain steps/processes simply cannot be performed by a human being in any viable fashion).

It will be recognized that while certain aspects of the disclosure are described in terms of specific design examples, these descriptions are only illustrative of the broader methods, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claims herein.

While the above detailed description has shown, described, and pointed out novel features of the disclosure as applied to various embodiments, it will be understood that various omissions, substitutions, and changes in the form and details of the device or process illustrated may be made by those skilled in the art. The foregoing description is of the best mode presently contemplated. This description is in no way meant to be limiting, but rather should be taken as illustrative of the general principles of the disclosure, the scope of which should be determined with reference to the claims.

What is claimed is:

1. A selectively accessible container apparatus, comprising:

a container comprising a container lid; and a hinge assembly coupled to the container and the container lid, the hinge assembly comprising:

first and second outer housing elements configured to house a plurality of internal components therein, the plurality of internal components comprising:

a shape memory alloy (SMA) filament;

a pull rod, the pull rod configured to be communicatively coupled with the SMA filament;

an inner ratchet element and a complementary outer ratchet head, where upon activation of the SMA filament, the pull rod is configured to pull the inner ratchet element away from the complementary outer ratchet head, thereby enabling the container lid to be actuated with respect to the container; and a return spring configured to return the inner ratchet element so as to communicatively engage the complementary outer ratchet head upon deactivation of the SMA filament.

2. The selectively accessible container apparatus of claim 1, wherein the plurality of internal components further comprises:

an SMA anchor plate comprising a printed circuit board, the SMA filament configured to be coupled to the SMA anchor plate, the SMA anchor plate configured to remain in a substantially fixed position within the hinge assembly.

3. The selectively accessible container apparatus of claim 2, wherein the printed circuit board further comprises a logical component, the logical component configured to selectively enable activation of the SMA filament.

4. The selectively accessible container apparatus of claim 3, wherein the logical component is configured to receive a password or code, the password or code configured to enable the selective activation of the SMA filament.

5. The selectively accessible container apparatus of claim 2, wherein the plurality of internal components further comprises:

a torsion spring, the torsion spring configured to provide a biasing force on the container lid thereby enabling automated opening of the container lid upon activation of the SMA filament.

6. The selectively accessible container apparatus of claim 5, wherein the inner ratchet element and the complementary outer ratchet head each comprise one or more teeth, the teeth when engaged frustrate the ability to rotate the container lid in a first direction while simultaneously permitting rotation of the container lid in a second direction.

7. The selectively accessible container apparatus of claim 6, wherein the first direction comprises an opening direction for the container lid and the second direction comprises a closing direction for the container lid.

8. The selectively accessible container apparatus of claim 7, wherein the plurality of internal components further comprises:

a cushion spring, the cushion spring configured to mitigate stresses on the SMA filament during engagement of the teeth of the inner ratchet element and the complementary outer ratchet head.

9. The selectively accessible container apparatus of claim 8, wherein the cushion spring is further configured to allow a defined motion for the inner ratchet element without the translation of motion to the pull rod and the SMA filament.

10. A hinge assembly, comprising:

an outer housing element, the outer housing element configured to house a plurality of internal components, the plurality of internal components comprising:

a printed circuit board, the printed circuit board configured to be communicatively coupled with the outer housing element;

a pivoting latch arm, the pivoting latch arm comprising a pivot point disposed between two opposing ends for the pivoting latch arm;

a traveling rod that is actuated via the use of a shape memory alloy (SMA) filament, the actuation of the traveling rod is configured to engage one of the two opposing ends of the pivoting latch arm;

wherein the other opposing end of the pivoting latch arm is configured to engage a respective feature located on a selectively accessible container.

11. The hinge assembly of claim 10, further comprising a return spring that is received concentrically around at least a portion of the traveling rod, the return spring configured to return the traveling rod to a non-actuated SMA filament position.

12. The hinge assembly of claim 11, wherein the traveling rod when in the non-actuated SMA filament position is configured to lock the selectively accessible container.

13. The hinge assembly of claim 12, wherein two ends of the SMA filament are configured to be held at an anchor point located within the outer housing element.

14. The hinge assembly of claim 13, wherein an outer end of the traveling rod is configured to have the SMA filament routed around the outer end.

15. The hinge assembly of claim 10, wherein the printed circuit board further comprises a logical component, the logical component configured to selectively enable activation of the SMA filament.

16. The hinge assembly of claim 15, wherein the logical component is configured to receive a password or code, the password or code configured to enable the selective activation of the SMA filament.

17. The hinge assembly of claim 15, wherein the logical component is configured to receive an activation signal, the activation signal being generated in response to receipt of a password or code.

18. A method of providing selectable access to a container located at a first location, the method comprising:

providing a hinge assembly, the provision of the hinge assembly comprising:

obtaining a plurality of components to form a hinge assembly for the container, the plurality of components comprising a circuit board having a logic component disposed thereon and a shape memory alloy (SMA) filament; and inserting the circuit board having the logic component disposed thereon and the SMA filament into one or more housing portions for the hinge assembly;

causing the attachment of the hinge assembly to the container;

causing the receipt of an activation signal at the hinge assembly at the first location, the activation signal generated at a second location, the second location being remote from the first location; and in response to receipt of the activation signal, causing the hinge assembly to open thereby providing access to contents located within the container.

19. The method of claim 18, further comprising providing the container having the hinge assembly attached thereto.

20. The method of claim 18, further comprising providing a standardized specification for the container, the standardized specification configured to enable the attachment of the hinge assembly to the container.

* * * * *